US009174111B2

(12) United States Patent
Smith et al.

(10) Patent No.: US 9,174,111 B2
(45) Date of Patent: Nov. 3, 2015

(54) PROTECTIVE ATHLETIC EQUIPMENT

(71) Applicant: Warrior Sports, Inc., Warren, MI (US)

(72) Inventors: Peter B. Smith, Montreal (CA); Neal A. Watts, Montreal (CA); François O. Dagneau, Montreal (CA)

(73) Assignee: Warrior Sports, Inc., Warren, MI (US)

( * ) Notice: Subject to any disclaimer, the term of this patent is extended or adjusted under 35 U.S.C. 154(b) by 309 days.

(21) Appl. No.: 13/657,940

(22) Filed: Oct. 23, 2012

(65) Prior Publication Data

US 2014/0007330 A1 Jan. 9, 2014

Related U.S. Application Data

(60) Provisional application No. 61/668,494, filed on Jul. 6, 2012.

(51) Int. Cl.
*A41D 13/08* (2006.01)
*A63B 71/08* (2006.01)
(Continued)

(52) U.S. Cl.
CPC ..... *A63B 71/08* (2013.01); *A63B 71/12* (2013.01); *A41D 13/0518* (2013.01); *A41D 13/08* (2013.01); *A63B 2071/1208* (2013.01); *A63B 2243/0045* (2013.01)

(58) Field of Classification Search
CPC ... A41D 13/0153; A41D 13/08; A63B 71/12; A63B 71/08
USPC ..... 2/16, 459, 461–464
See application file for complete search history.

(56) References Cited

U.S. PATENT DOCUMENTS 1,268,223 A 6/1918 Eimer
3,017,639 A 1/1962 Foley
(Continued)

FOREIGN PATENT DOCUMENTS

CA 2328023 6/2002
CA 2328337 6/2002
(Continued)

OTHER PUBLICATIONS

Easton Stealth RS Shoulder Pads, at least as early as May 14, 2012, downloaded from www.dickssportinggoods.com.
(Continued)

*Primary Examiner* — Khoa Huynh
*Assistant Examiner* — Megan Brandon
(74) *Attorney, Agent, or Firm* — Warner Norcross & Judd LLP

(57) ABSTRACT

An appendage protector for an article of protective gear is provided. The protector includes an upper arm protector portion, a lower arm protector portion, and a protective arm hinge overlying a gap between the upper and lower arm protector portions. The arm hinge includes a forward-facing floater pad, a medial extension, and a lateral extension. The medial and lateral extensions are slidably coupled to at least one of the upper and lower arm protector portions to guide forward movement of the floater pad during rotation of the lower arm protector portion toward the upper arm protector portion, and to guide rearward movement of the floater pad during rotation of the lower arm protector portion away from the upper arm protector portion. The arm protector can form part of a goaltender chest protector to provide an integrated system allowing fluid movement of the wearer's arm with enhanced protection to the elbow region.

19 Claims, 6 Drawing Sheets

(51) Int. Cl.

| | |
|---|---|
| ***A63B 71/12*** | (2006.01) |
| *A41D 13/05* | (2006.01) |

(56) References Cited

U.S. PATENT DOCUMENTS

| | | | | | |
|---|---|---|---|---|---|
| 3,158,871 | A | * | 12/1964 | Morgan | 2/462 |
| 3,523,057 | A | | 8/1970 | Buck | |
| 3,784,985 | A | | 1/1974 | Conroy | |
| 3,867,239 | A | | 2/1975 | Alesi et al. | |
| 3,872,511 | A | | 3/1975 | Nichols | |
| 4,067,063 | A | | 1/1978 | Ettinger | |
| 4,101,704 | A | | 7/1978 | Hiles | |
| 4,101,983 | A | | 7/1978 | Dera et al. | |
| 4,160,034 | A | | 7/1979 | Sauers | |
| 4,241,457 | A | | 12/1980 | Klein et al. | |
| 4,272,849 | A | | 6/1981 | Thurston et al. | |
| 4,322,859 | A | | 4/1982 | Mitchell | |
| 4,409,689 | A | * | 10/1983 | Buring | A63B 71/1225 2/22 |
| 4,441,211 | A | | 4/1984 | Donzis | |
| 4,467,475 | A | | 8/1984 | Gregory et al. | |
| 4,484,361 | A | | 11/1984 | Leighton et al. | |
| 4,486,901 | A | | 12/1984 | Donzis | |
| 4,590,622 | A | * | 5/1986 | Wolfe et al. | 2/462 |
| 4,639,944 | A | * | 2/1987 | Lashley et al. | 2/456 |
| 4,642,814 | A | | 2/1987 | Godfrey | |
| 4,654,893 | A | | 4/1987 | Meyers et al. | |
| 4,694,505 | A | * | 9/1987 | Flosi et al. | 2/462 |
| 4,723,322 | A | | 2/1988 | Shelby | |
| 4,810,559 | A | | 3/1989 | Fortier et al. | |
| 4,872,216 | A | | 10/1989 | Wingo, Jr. | |
| 4,874,640 | A | | 10/1989 | Donzis | |
| 4,884,561 | A | * | 12/1989 | Letson, Sr. | 602/16 |
| 4,985,931 | A | | 1/1991 | Wingo, Jr. | |
| 4,989,265 | A | | 2/1991 | Nipper et al. | |
| 5,007,108 | A | * | 4/1991 | Laberge et al. | 2/463 |
| 5,029,341 | A | | 7/1991 | Wingo, Jr. | |
| 5,054,121 | A | | 10/1991 | Mitchell | |
| 5,129,101 | A | | 7/1992 | Douglas | |
| 5,159,715 | A | | 11/1992 | Jurga et al. | |
| 5,168,576 | A | | 12/1992 | Krent et al. | |
| 5,204,993 | A | * | 4/1993 | Siemens | 2/461 |
| 5,222,256 | A | * | 6/1993 | Wang | 2/24 |
| 5,235,703 | A | | 8/1993 | Maynard | |
| 5,496,610 | A | | 3/1996 | Landi et al. | |
| 5,537,688 | A | | 7/1996 | Reynolds et al. | |
| 5,623,728 | A | * | 4/1997 | Wagner | 2/462 |
| 5,640,712 | A | | 6/1997 | Hansen et al. | |
| 5,655,221 | A | * | 8/1997 | Worischeck | 2/16 |
| 5,662,594 | A | * | 9/1997 | Rosenblatt | 602/16 |
| 5,794,275 | A | | 8/1998 | Donzis | |
| 5,840,397 | A | | 11/1998 | Landi et al. | |
| 5,881,395 | A | | 3/1999 | Donzis | |
| 5,890,232 | A | | 4/1999 | Park | |
| 5,920,915 | A | | 7/1999 | Bainbridge et al. | |
| 5,926,857 | A | * | 7/1999 | Blondeau | 2/456 |
| 5,987,654 | A | * | 11/1999 | Chartrand | 2/462 |
| 5,996,117 | A | | 12/1999 | Goldsmith et al. | |
| 6,035,452 | A | | 3/2000 | Braxton | |
| 6,070,273 | A | | 6/2000 | Sgro | |
| 6,076,185 | A | * | 6/2000 | Schramm | 2/16 |
| 6,093,468 | A | | 7/2000 | Toms et al. | |
| 6,094,743 | A | * | 8/2000 | Delgado | 2/16 |
| 6,128,779 | A | | 10/2000 | Goldsmith et al. | |
| 6,131,196 | A | | 10/2000 | Vallion | |
| 6,151,714 | A | | 11/2000 | Pratt | |
| 6,175,967 | B1 | | 1/2001 | Donzis | |
| 6,226,820 | B1 | | 5/2001 | Navarro | |
| 6,253,376 | B1 | | 7/2001 | Ritter | |
| 6,336,220 | B1 | | 1/2002 | Sacks et al. | |
| 6,347,413 | B1 | | 2/2002 | Sciscente et al. | |
| 6,421,839 | B1 | | 7/2002 | Vo et al. | |
| 6,500,507 | B1 | | 12/2002 | Fisher | |
| 6,519,780 | B2 | | 2/2003 | Goodwin | |
| 6,543,057 | B2 | | 4/2003 | Beland et al. | |
| 6,584,615 | B1 | | 7/2003 | Wilder et al. | |
| 6,591,429 | B1 | | 7/2003 | Jaszai | |
| 6,671,889 | B2 | | 1/2004 | Dennis et al. | |
| 6,687,912 | B2 | | 2/2004 | Collins et al. | |
| 6,775,845 | B2 | * | 8/2004 | Eghamn | A63B 71/1225 2/22 |
| 6,785,909 | B1 | | 9/2004 | Li | |
| 6,807,891 | B2 | | 10/2004 | Fisher | |
| 6,813,781 | B2 | | 11/2004 | Wilder et al. | |
| 6,839,910 | B2 | | 1/2005 | Morrow et al. | |
| 6,880,172 | B2 | * | 4/2005 | Quintero | 2/16 |
| 6,969,548 | B1 | | 11/2005 | Goldfine | |
| 7,103,924 | B2 | | 9/2006 | Morrow et al. | |
| 7,114,188 | B1 | | 10/2006 | Teigen | |
| 7,143,447 | B2 | | 12/2006 | Fleischmann | |
| 7,235,038 | B2 | * | 6/2007 | Liao | 482/44 |
| 7,275,268 | B2 | | 10/2007 | Gait | |
| 7,313,830 | B2 | | 1/2008 | Desjardins et al. | |
| 7,313,831 | B2 | | 1/2008 | Wilder et al. | |
| 7,341,776 | B1 | | 3/2008 | Milliren et al. | |
| 7,487,556 | B2 | | 2/2009 | Morrow et al. | |
| 7,608,314 | B2 | | 10/2009 | Plant | |
| 7,647,651 | B2 | * | 1/2010 | Contant et al. | 2/459 |
| 7,661,148 | B2 | | 2/2010 | Landi et al. | |
| 7,730,549 | B2 | | 6/2010 | Morrow et al. | |
| 7,770,233 | B2 | | 8/2010 | Haskell | |
| 7,774,866 | B2 | | 8/2010 | Ferrara | |
| 7,784,110 | B2 | | 8/2010 | Jourde et al. | |
| 7,797,760 | B2 | | 9/2010 | Morrow et al. | |
| 7,802,315 | B2 | | 9/2010 | Contant et al. | |
| 7,827,625 | B2 | * | 11/2010 | Morrow et al. | 2/463 |
| 7,861,321 | B2 | | 1/2011 | Winningham | |
| 7,882,576 | B2 | * | 2/2011 | Morrow et al. | 2/462 |
| 7,987,526 | B2 | | 8/2011 | Durham | |
| 8,039,078 | B2 | | 10/2011 | Moore, III et al. | |
| 8,062,446 | B1 | | 11/2011 | Beauregard et al. | |
| 8,065,750 | B2 | | 11/2011 | Dassler et al. | |
| 8,082,602 | B2 | | 12/2011 | Crelinsten et al. | |
| 8,108,951 | B2 | | 2/2012 | Gabry et al. | |
| 8,181,275 | B2 | | 5/2012 | Saturnio | |
| 8,262,594 | B2 | | 9/2012 | Sandusky et al. | |
| 2002/0069454 | A1 | * | 6/2002 | Beland | 2/462 |
| 2005/0223477 | A1 | * | 10/2005 | Batstone et al. | 2/463 |
| 2006/0010590 | A1 | | 1/2006 | Huschke et al. | |
| 2007/0101474 | A1 | | 5/2007 | Skottheim et al. | |
| 2007/0234460 | A1 | * | 10/2007 | Castonguay et al. | 2/16 |
| 2008/0134419 | A1 | | 6/2008 | Kalaam et al. | |
| 2008/0244812 | A1 | * | 10/2008 | Phaneuf et al. | 2/462 |
| 2009/0271916 | A1 | * | 11/2009 | Harris | 2/456 |
| 2010/0306907 | A1 | | 12/2010 | Fiegener et al. | |
| 2010/0306908 | A1 | * | 12/2010 | Fiegener et al. | 2/463 |
| 2011/0307999 | A1 | * | 12/2011 | Jourde et al. | 2/462 |
| 2013/0305439 | A1 | * | 11/2013 | Contant et al. | 2/459 |

FOREIGN PATENT DOCUMENTS

| | | |
|---|---|---|
| CA | 2252507 | 8/2005 |
| DE | 4200056 | 7/1993 |
| DE | 10244236 | 3/2004 |
| EP | 1190647 | 3/2002 |
| EP | 1588636 | 10/2005 |
| GB | 1562191 | 3/1980 |
| GB | 2154124 | 9/1985 |
| WO | 8806513 | 9/1988 |
| WO | 9205717 | 4/1992 |
| WO | 2008139217 | 11/2008 |
| WO | 2011091514 | 8/2011 |

OTHER PUBLICATIONS

Easton Stealth RS Shin Guards, at least as early as May 14, 2012, downloaded from www.icewarehouse.com.

Easton Stealth RS Elbow Pads, at least as early as May 14, 2012, downloaded from www.totalhockey.com.

Easton Stealth RS Ice Hockey Pants, at least as early as May 14, 2012, downloaded from www.hockeymoneky.com.

CCM U+CL Shoulder Pads, at least as early as May 14, 2012, downloaded from www.ccmhockey.com.

(56) References Cited

OTHER PUBLICATIONS

CCM U+CL Elbow Pads, at least as early as May 14, 2012, downloaded from www.ccmhockey.com.
CCM U+CL Ice Hockey Pants, at least as early as May 14, 2012, downloaded from www.hockeymonkey.com.
Reebok 11K Shoulder Pads, at least as early as May 14, 2012, downloaded from www.purehockey.com.
Reebok 11K Shin Guards, at least as early as May 14, 2012, downloaded from www.totalhockey.com.
Bauer Supreme TotalONE Shoulder Pads, at least as early as May 14, 2012, downloaded from www.purehockey.com.
Bauer Supreme TotalONE Shine Guards, at least as early as May 14, 2012, downloaded from www.hockeymonkey.com.
Bauer Supreme TotalONE Ice Hockey Pants, at least as early as May 14, 2012, downloaded from www.hockeymonkey.com.
Bauer Supreme TotalONE Protective Line using F-One Cap Technology (hockey), at least as early as May 14, 2012, downloaded from www.hockeymoneky.com.
Alpinestars MOAB Shin-Knee Pads, at least as early as May 14, 2012, downloaded from www.backcountry.com.
Alpinestars MOAB Elbow Pads, at least as early as May 14, 2012, downloaded from www.backcountry.com.

* cited by examiner

PROTECTIVE ATHLETIC EQUIPMENT

BACKGROUND OF THE INVENTION

The present invention relates to protective athletic equipment, and in particular, upper body protective athletic equipment.

Protective athletic equipment, and in particular chest protectors, generally seek a balance between protection and freedom of movement for the wearer. For example, goaltender chest protectors are generally constructed to protect against high velocity hockey puck impacts, while also allowing rapid arm movement to intercept elevated shots and to allow control of the goalie stick during play. Though commonly referred to as chest protectors, these articles of protective equipment typically include protection for the wearer's abdomen, shoulders and arms, in addition to the wearer's chest.

Many existing chest protectors offer a compromise between protection and freedom of movement. In the elbow region, for example, many existing chest protectors include an oversized rectangular cuff having a fold-line that mirrors the natural bend in the elbow. Sometimes referred to as an arm hinge, the rectangular cuff typically includes impact resistant foam and upper and lower adjustable straps that extend around the back of the wearer's elbow. While providing satisfactory protection, the rectangular cuff can inhibit flexion of the arm, and can move out of position during play. For example, the rectangular cuff can slow elevated movement of the glove hand during catching motions, and can ride up on a wearer's bicep during play, leaving the inner elbow exposed to possible impacts with a puck or another player's stick.

Accordingly, there remains room for improvement to provide a chest protector having satisfactory protection and freedom of movement in the elbow region, and which facilitates movement throughout a range of arm motions while also remaining in position over the wearer's elbow.

SUMMARY OF THE INVENTION

An appendage protector, optionally for use in connection with an upper body protector, is provided. The appendage protector can be in the form of an arm protector for use with a chest protector.

In one embodiment, the arm protector can include the arm hinge including a forward-facing floater pad, a medial extension, and a lateral extension. The medial and lateral extensions are slidably coupled to the upper and/or lower arm protector portions to guide forward movement of the floater pad during rotation of the lower arm protector portion toward the upper arm protector portion, and to guide rearward movement of the floater pad during rotation of the lower arm protector portion away from the upper arm protector portion.

In another embodiment, the upper and lower arm protector portions are pivotably coupled to each other about respective medial and lateral pivot elements. The pivot elements extend into respective channels in the medial and lateral extensions, and include an oversized head portion to maintain the pivot elements therein. The respective channels are linear in this embodiment, extending generally along an axis from the tip of the elbow toward the crook of the elbow, but can be non-linear or curved in other embodiments.

In yet another embodiment, the protective arm hinge includes a forward-facing floater pad defining first and second vertically spaced-apart fold lines. The floater pad additionally includes a first elastic strap extending across the lower arm protector portion and a second elastic strap extending across the upper arm protector portion to bias the floater pad over the gap between the upper and lower arm protector portions. The floater pad, the medial extension, and the lateral extension can include a substantially rigid interior plate sandwiched between outer protective foam layers.

In still another embodiment, the medial and lateral pivot elements, which can be in the form of pins, extend through overlapping through-holes in the bicep cap and the forearm cap to provide a hinged connection between the upper arm protector portion and the lower arm protector portion. The upper arm protector portion includes a substantially rigid bicep cap and a bicep-contacting layer extending across spaced-apart portions of the bicep cap, thereby defining an air gap between the padding layer and the bicep cap. The lower arm protector portion includes a substantially rigid forearm cap and a forearm-contacting layer extending across spaced-apart portions of the forearm cap, thereby defining an air gap between the padding layer and the forearm cap. The respective air gaps facilitate the distribution of an impact across a substantial portion of the forearm-contacting padding layer and/or the bicep-contacting padding layer.

The embodiments herein provide an improved upper body protector having increased mobility in the elbow region with enhanced protection against impacts to the forearm and bicep regions. Where included, the upper arm protector portion, the lower arm protector portion, and the protective arm hinge form an integrated system allowing fluid movement of the wearer's arm without comprising comfort or protection, and are particularly well adapted for use in ice hockey, roller hockey, lacrosse, and other sports or activities.

These and other advantages and features of the invention will be more fully understood and appreciated by reference to the description of the current embodiments and the drawings.

DESCRIPTION OF THE CURRENT EMBODIMENTS

The current embodiments relate to an arm protector used in conjunction with a chest protector, for example, a goaltender chest protector, to provide improved arm protection. As described fully below, the arm protector provides an integrated system of protective arm padding allowing fluid movement of the wearer's arm with enhanced protection in the elbow region, the forearm region, and the bicep region. Although described in connection with an arm protector, the present protective gear could be used with virtually any appendage. Moreover, although described in connection with sporting goods, such as those used in connection with ice hockey, roller hockey, lacrosse, and other sports, the protective gear herein can be used in connection with law enforcement, military, and occupational gear as well.

Figure 1:
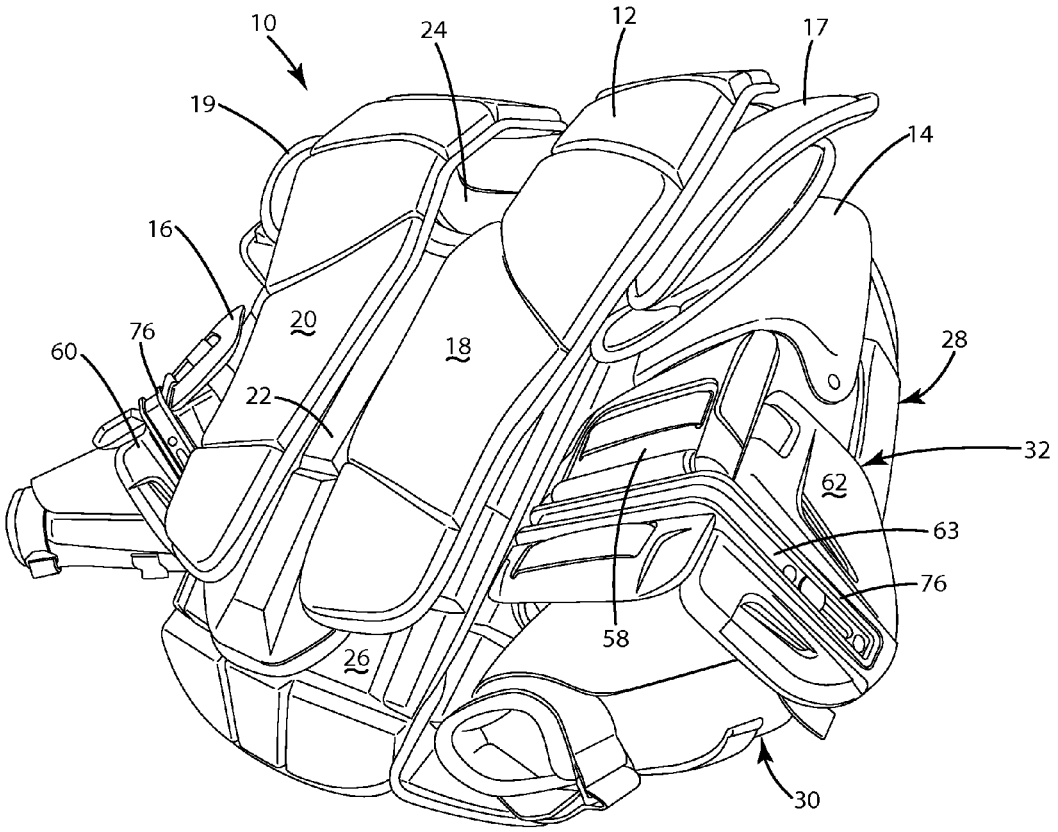
FIG. 1 is a perspective view of a chest protector of a current embodiment.

A chest protector including the arm protectors of the current embodiment is generally shown in FIG. 1 and designated 10. The chest protector 10 includes a torso protector portion 12 and left and right arm protectors 14, 16. The torso protector portion 12 includes left and right chest portions 18, 20, left and right shoulder portions 17, 19, a middle chest portion 22, a protective collar 24, and an abdominal protector 26. Each of these portions of the torso protector 12 can include impact resistant foam elements within a tear-resistant outer fabric. For example, the left and right chest portions 18, 20 can include open-cell or closed-cell compression-molded foam segments within an outer nylon webbing.

As noted above, the chest protector portion 10 additionally includes left and right arm protectors 14, 16. Although shown as being joined to the torso protector portion 12 in FIG. 1, the left and right arm protectors 14, 16 can be separated from the torso protector portion 12 to serve as a stand-alone protective element in certain applications. The left and right arm protectors 14, 16 each include an upper arm portion 28, a lower arm portion 30, a protective arm hinge 32 and an elbow cap 34. The upper and lower arm portions 28, 30 are sized and shaped to conform to the wearer's bicep/tricep and forearm, respectively, while the arm hinge 32 and the elbow cap 34 cooperate to provide protection to the wearer's elbow region. As explained in more detail below, the arm hinge 32 overlies a forward-facing gap or space 100 between the upper and lower arm portions 28, 30 to protect the bend or crease in the elbow, while the elbow cap 34 (FIGS. 9-10) is shaped to conform to the tip of the elbow of a wearer.

Figure 2:
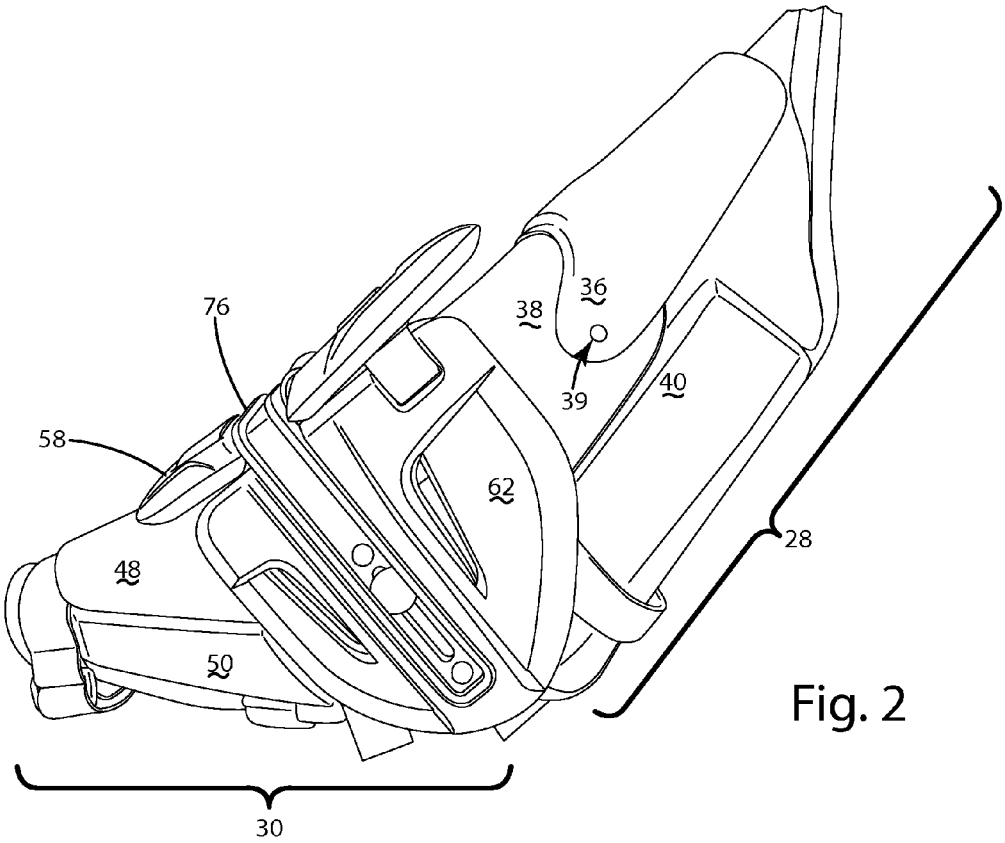
FIG. 2 is a side elevation view of an arm protector of a current embodiment.
Figure 3:
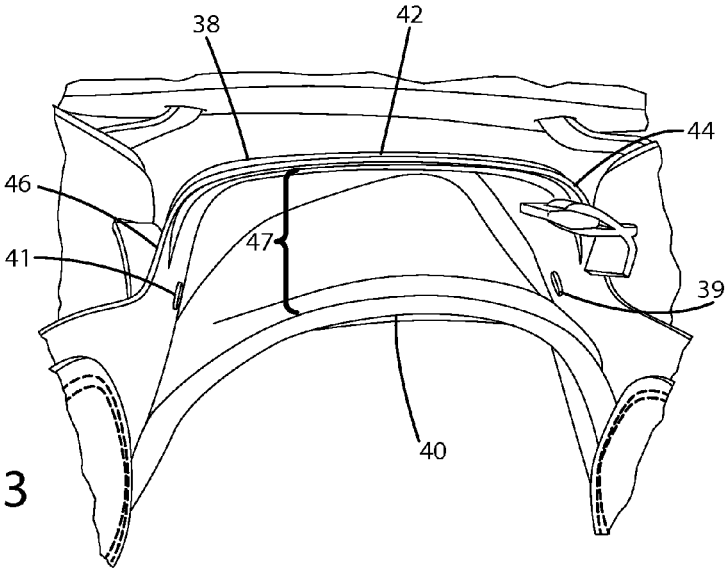
FIG. 3 is a top view of a bicep cap of the arm protector of FIG. 2.

Referring now to FIG. 2, the upper arm portion 28 includes upper and lower bicep caps 36, 38 and a bicep-contacting padding 40 underlying the upper and lower bicep caps 36, 38. As generally shown in FIG. 3, the bicep caps 36, 38 define an inverted u-shaped cross-section in the current embodiment, having a forward-facing central portion 42 and lateral and medial side portions 44, 46 to partially circumferentiate a wearer's bicep. The bicep-contacting padding 40 is stitched or otherwise coupled to the lateral and medial side portions 44, 46 of the lower bicep cap 36, leaving a gap 47 between the central portion 42 and the bicep-contacting padding 40 as perhaps best shown in FIG. 3. This gap 47 assists in providing a "trampoline effect" to disperse an impact on a bicep cap 36, 38 across a substantial portion of the bicep-contacting padding 40, rather than transferring the impact force to a localized region of the bicep-contacting padding 40. As also depicted in FIG. 3, the bicep-contacting padding 40 is dimensioned to extend around, and conform to, the wearer's upper arm. The bicep-contacting padding 40 is optionally formed of an impact absorbing foam, for example a polyurethane foam or a polyethylene foam, while the bicep caps 36, 38 are optionally formed of a rigid plastic, for example high density polyethylene.

Figure 4:
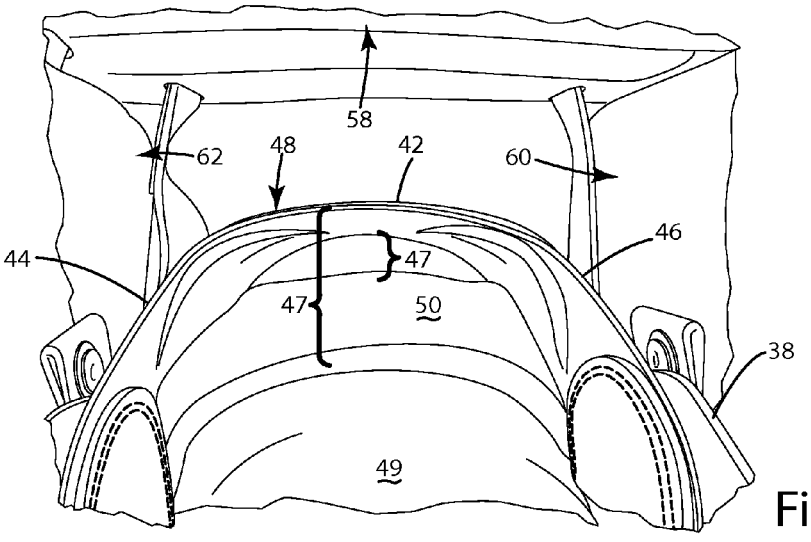
FIG. 4 is a top view of a forearm cap of the arm protector of FIG. 2.

Similar to the upper arm portion 28, the lower arm portion 30 can include a substantially rigid forearm cap 48 and a forearm-contacting padding 50 underlying the forearm cap 48. The forearm cap 48 arm padding 50 can be substantially similar in construction and function as the bicep caps 36, 38 and padding 40, and therefore will not be described in detail here. Suffice it to say that the cap can define an inverted u-shaped cross-section, having a central portion 42 and lateral and medial side portions 44, 46, with forearm-contacting padding 50 stitched or otherwise coupled to the lateral and medial side portions of the forearm cap, leaving a gap 47 between the central portion of the forearm cap 42 and the forearm-contacting padding 50, to provide the above noted "trampoline effect," that is, dispersing an impact on the forearm cap 48 across a substantial portion of the forearm-contacting padding 50, rather than transferring the impact force to a localized region of the forearm-contacting padding 50. In addition, the forearm-contacting padding 50 is dimensioned to extend around, and conform to, the wearer's forearm as generally depicted in FIG. 4. The forearm-contacting padding 50 is optionally formed of an impact absorbing foam, for example a polyurethane foam or a polyethylene foam, while the forearm cap 48 is optionally formed of a rigid plastic, for example high density polyethylene. The forearm-contacting padding 50 can additionally include a removable liner 49 that bridges the lower arm portion 30 and the upper arm portion 28 across a gap 100 in the inner elbow region. The removable liner 49 is separable from the upper and lower arm portions 28, 30 in the present embodiment, optionally being formed of a thin layer of breathable, lightweight foam, covered by a fabric or other material.

Figure 5:
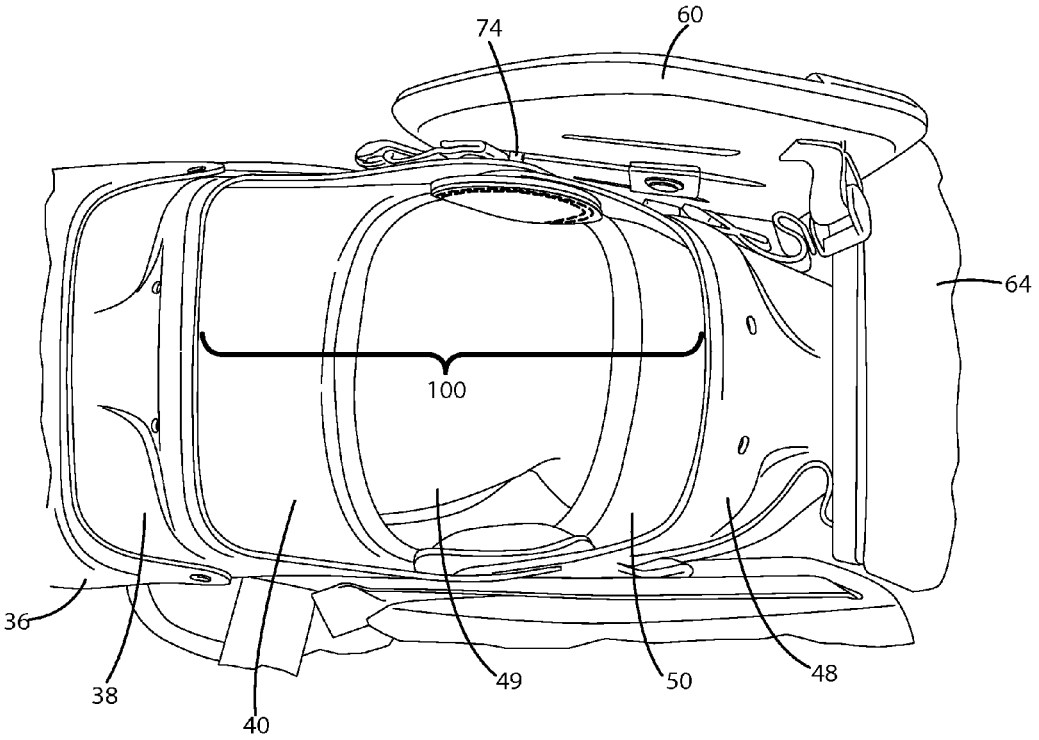
FIG. 5 is a close-up view of the gap between the bicep and forearm caps.

To facilitate articulation of the lower arm portion 30 relative to the upper arm portion 28, the forearm cap 48 includes through-holes in alignment with through-holes in the lower bicep cap 38. Each through-hole extends through medial or lateral portions of a corresponding cap for receipt of respective medial and lateral pivot elements therein. Optionally, in a similar fashion, the upper bicep cap 36 and the lower bicep cap 38 include through-holes in alignment with each other for receipt of pivot elements 39, 41 therein. In use, as the wearer's arm flexes, the forearm cap 48 rotates toward to the lower bicep cap 38, decreasing the size of the generally V-shaped gap or generally triangular space 100 between the forearm cap 48 and the lower bicep cap 38. As the wearer's arm extends, the forearm cap 48 rotates away from the bicep cap 38, increasing the gap or space 100 (FIG. 5) between the forearm cap 48 and the lower bicep cap 38, and optionally opening up the "V" or "U" shape. In this regard, the bicep caps 36, 38 and the forearm cap 48 form an articulating linkage with enhanced protection across the forward-facing surface of the wearer's arms—a region where a goalie is especially likely to intercept a high-velocity puck during game play.

To provide protection to the wearer's elbow region, the arm hinge 32 overlies the gap or space 100 between the forearm cap 48 and the lower bicep cap 38. In particular, the arm hinge 32 includes a forward-facing floater pad 58, a medial extension 60, and a lateral extension 62. Although the floater pad 58 is described herein as being "forward facing," it is to be understood that this generally can mean that the floater pad 58 faces forward when the arm of a user is positioned at their side, with the bend of the elbow and palm of the hand facing in a forward direction, away from the front of a user's body. In some postures, however, the floater pad 58 does not appear to be "forward facing" away from the user's body, but is directed toward the torso of the wearer. This is because in a typical goalie stance, the wearer places their arms in a generally "V" shaped configuration extending outwardly, with the elbows pointed away from the torso to present as large an obstacle as possible within the goal.

Figure 7:
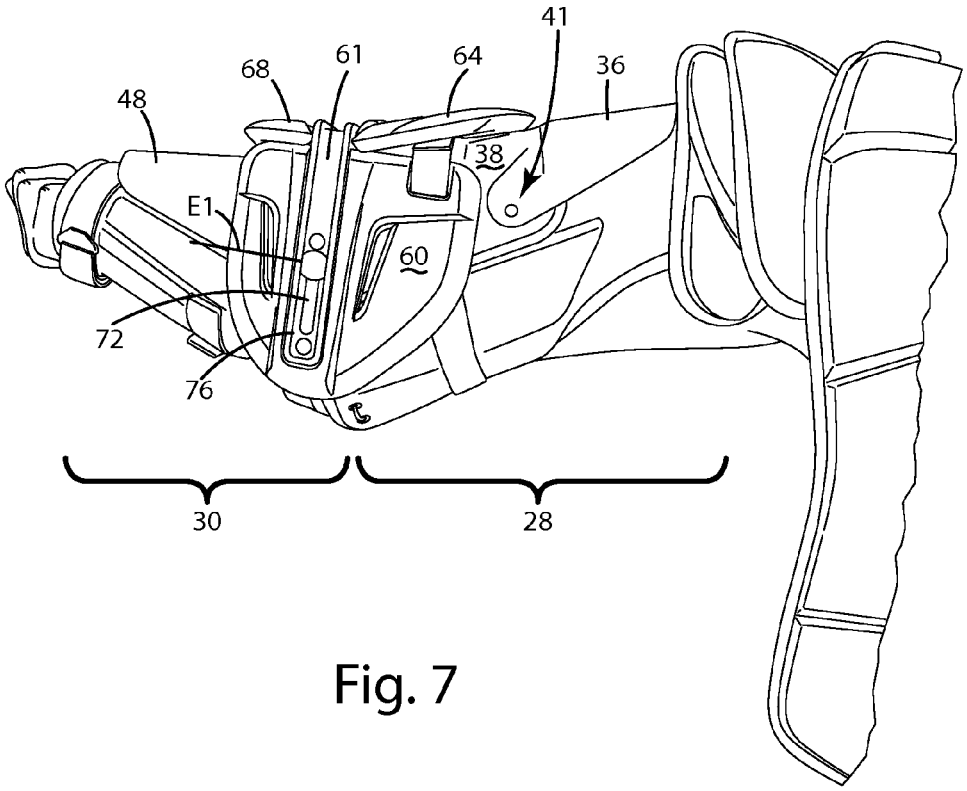
FIG. 7 is a side view of the arm hinge of FIG. 6 in an extended mode.

Further, the medial extension 60 and lateral extension 62 refers to the position of the extensions relative to the arm when a user has their arm placed immediately adjacent the side of their body, generally with the bend of the elbow facing forward of the body as shown in the figures. The medial extension 60 and lateral extension 62 in the figures appear to be facing forward and rearward relative to the torso of the body in FIGS. 7-8. Again, this is because of the stance of the goalie when tending goal with the elbows pointed out so that the forearm and upper arm form a "V" shape to maximize the area consumed by the goalie's arm.

Figure 6:
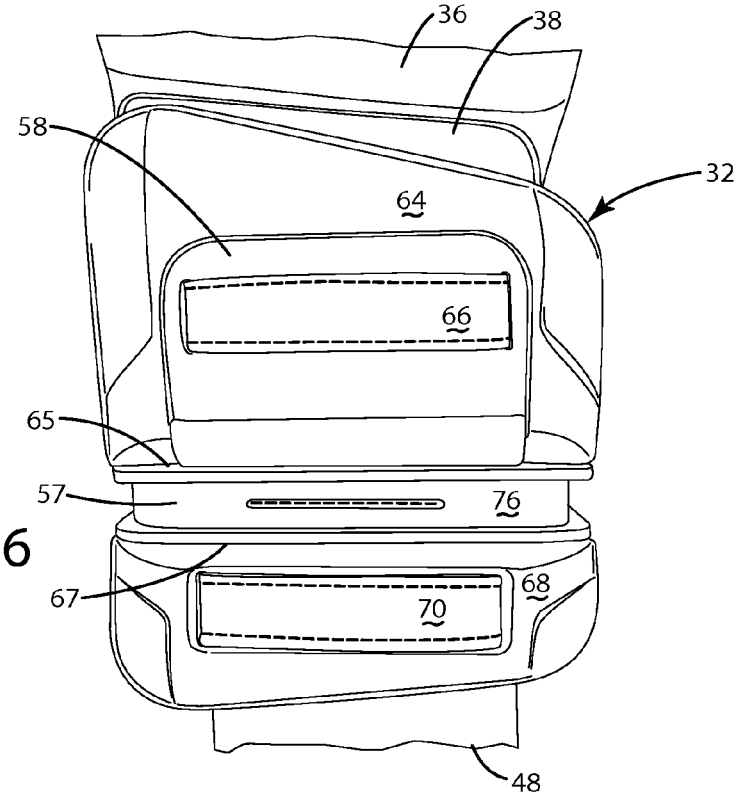
FIG. 6 is a front view of an arm hinge of a current embodiment.

As shown in FIG. 6, the floater pad 58 is generally trapezoidal in the present embodiment, including first and second vertically spaced apart fold lines 65, 67 extending across the width of the floater pad 58 to allow the floater pad 58 to fold or collapse forwardly, generally within the "V" or "U" shaped gap between a wearer's bicep and forearm, during flexion of the wearer's arm. The floater pad 58 includes an upper portion 64 having an elastic strap 66 extending around the upper arm portion 28, and optionally through an opening 59 in the medial and lateral extensions 60, 62. The floater pad 58 additionally includes a lower portion 68 having an elastic strap 70 extending around the lower arm portion 30. In use, the elastic straps 66, 70 urge the floater pad upper portion 64 against the bicep cap 36 and urge the floater pad lower portion 68 against the forearm cap 48 to thereby cover the gap 100 between the lower bicep cap 38 and the forearm cap 48.

Figure 8:
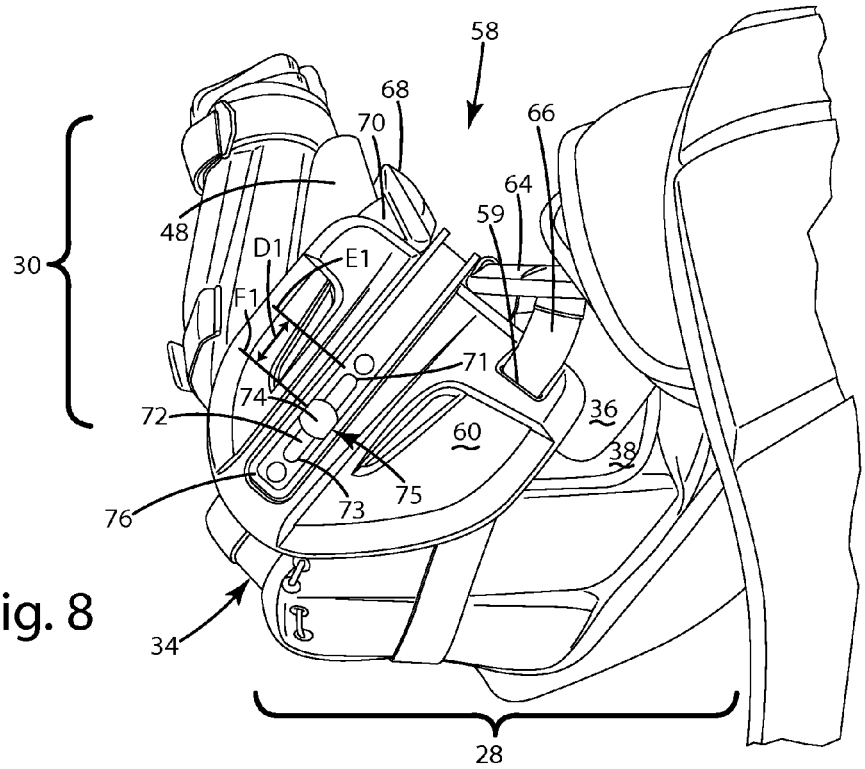
FIG. 8 is a side view of the arm hinge of FIG. 5 in a flexed mode.

The floater pad 58 can be formed of any material adapted to disperse an impact over a larger area. Optionally, the floater pad 58 is constructed so that it is generally resilient and tending to extend to its extended mode EM (FIG. 7) from its flexed mode FM (FIG. 8). The floater pad 58 can also assist in pulling the medial and lateral extensions via a bridge 76 as further described below. The floater pad 58 further optionally can include an interior plate sandwiched between foam layers. For example, the interior plastic plate can include a high density polyethylene, while the outer foam layers can include polyurethane foam or polyethylene foam.

As noted above, the arm hinge 32 includes a medial extension 60 and a lateral extension 62. Optionally, each extension is joined to the floater pad 58 along a vertical fold line, such that the medial and lateral extensions 60, 62 fold rearwardly to cover the medial and lateral portions of the wearer's elbow. Alternatively, the floater pad and extensions can be joined with one another along a seam or attached with a flexible material or otherwise joined with one another, in which case they are not folded relative to one another.

Further, the lateral and medial extensions 60, 62 can be generally configured to conceal or cover the generally triangular shaped gap or space between the bicep and forearm of a wearer and, more particularly, the lower bicep cap 38 and the forearm cap 48. As shown in FIG. 8, the lateral and medial extensions 60, 62, as well as the floater pad 58, when in a flexed mode, can generally conceal and protect the elbow gap or space formed between the lower bicep cap 38 and the forearm cap 48. This can provide enhanced protection to the wearer in the inner elbow region, particularly on the interior or forward facing bend of the elbow. In addition, this added padding can close off a portion of the space, which can prevent pucks or other sporting elements from passing between the user's bicep and forearm, thereby improving the goalkeeping capabilities of the wearer.

Optionally, each extension 60, 62 can include an elongate slot, recess or channel 72 to receive a pivot element or guide element, such as a guide pin 74 therein. The elongate channel 72 is linear in the current embodiment, but can be curved or arcuate, depending on the defined movement of the lateral and medial extensions. As shown in FIG. 8, the elongate channel 72 includes spaced-apart end portions 71, 73 that limit forward and rearward movement of the floater pad 58. The forward end portion 71 limits rearward movement of the floater pad 58, ensuring an air gap exists between the floater pad 58 and the break or curve in the wearer's elbow. In addition, the rearward end portion 73 limits forward movement of the floater pad 58, ensuring at least a portion of the floater pad 58 overlies the bend in the wearer's elbow, particularly during flexion of the wearer's arm.

Again referring to FIG. 8, movement of the guide pin 74 within the channel 72 is further illustrated. During flexion of the arm protector 14 from the extended mode EM to the flexed mode FM, the guide pin 74 travels rearwardly within the channel 72. Conversely, during extension of the arm protector 14 from the flexed mode FM to the extended mode EM, the guide pin 74 travels forwardly within the channel 72. For example, the guide pin 74 is shown at position F1 within the channel 72, spaced a distance D1 from the forward end portion 71 in flexed mode FM. During extension of the wearer's arm, the guide pin 74 travels forwardly a distance D1 until E1 is reached. During the following flexion of the wearer's arm, the guide pin 74 travels rearwardly a distance D1 (or some other distance) until F1 (or some other point) is reached, depending on the degree of flexion desired by the wearer. Throughout this range of motion, the guide pin 74 of FIG. 8 maintains the medial extension 60 in close registration against the wearer's elbow, while a corresponding guide pin 74 extending through the lateral extension 62 maintains the lateral extension 62 in close registration against the wearer's elbow.

As noted above, the arm hinge 32 includes a bridge 76 joined to the floater pad 58 and to the medial and lateral extensions 60, 62. The bridge 76 operates to strengthen the coupling between the floater pad 58 and the medial and lateral extensions 60, 62, while also optionally reinforcing the elongated channel 72. In the present embodiment, the bridge 76 is substantially rigid and generally U-shaped. For example, the bridge is formed from high density polyethylene in the present embodiment, but can be formed of other materials as desired. In addition, the generally U-shaped bridge 76 includes a forward facing portion 57, a medial portion 61, and a lateral portion 63 overlying the floater pad 58, the medial extension 60, and the lateral extension 62, respectively. As optionally shown in FIG. 6, the forward facing portion extends laterally in the region between the first and second vertically spaced apart fold lines 65, 67. The elongate channels 72 extend through the medial and lateral bridge portions 61, 63 in some embodiments, while in other embodiments the elongate channels 72 are concealed from view, being generally behind the medial and lateral bridge portions.

The channel guide pins 74 are optionally an extension of the lateral and medial pivot pins that couple the lower bicep cap 38 to the forearm cap 48. In other embodiments, however, the channel guide pins 74 can be different from the lateral and medial pivot pins, and can include posts integrally molded with the lower bicep cap 38, the forearm cap 40, and/or the elbow cap 34, or other features of the arm hinge. As perhaps best shown in FIG. 8, the guide pin 74 of the current embodiment includes an oversized head portion 75 to maintain the guide pin 74 in the channel 72, for example, having a head diameter greater than the channel width. In some embodiments, the oversized head portion 75 can be flush with the outer surface of the medial extension 60, while also bearing a product logo, mark or decal. Optionally, the oversized head 75 can capture the medial and lateral extensions 60, 62, generally holding them closely to the arm and/or elbow of the wearer, and preventing them from flopping away from these body parts.

Figure 9:
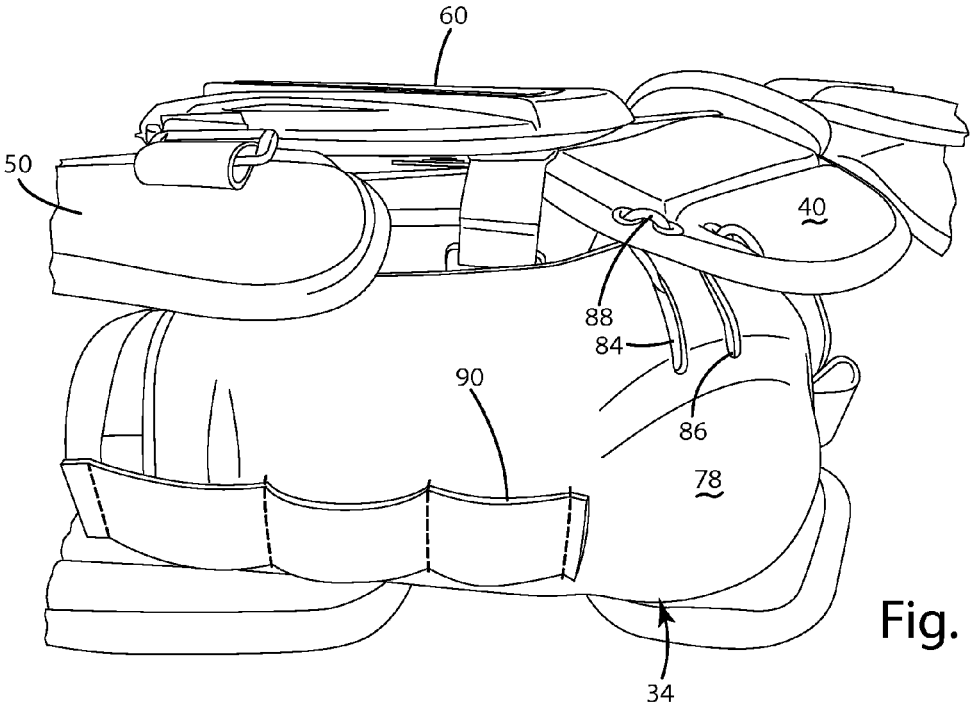
FIG. 9 is a first close-up view of an elbow cap of a current embodiment.
Figure 10:
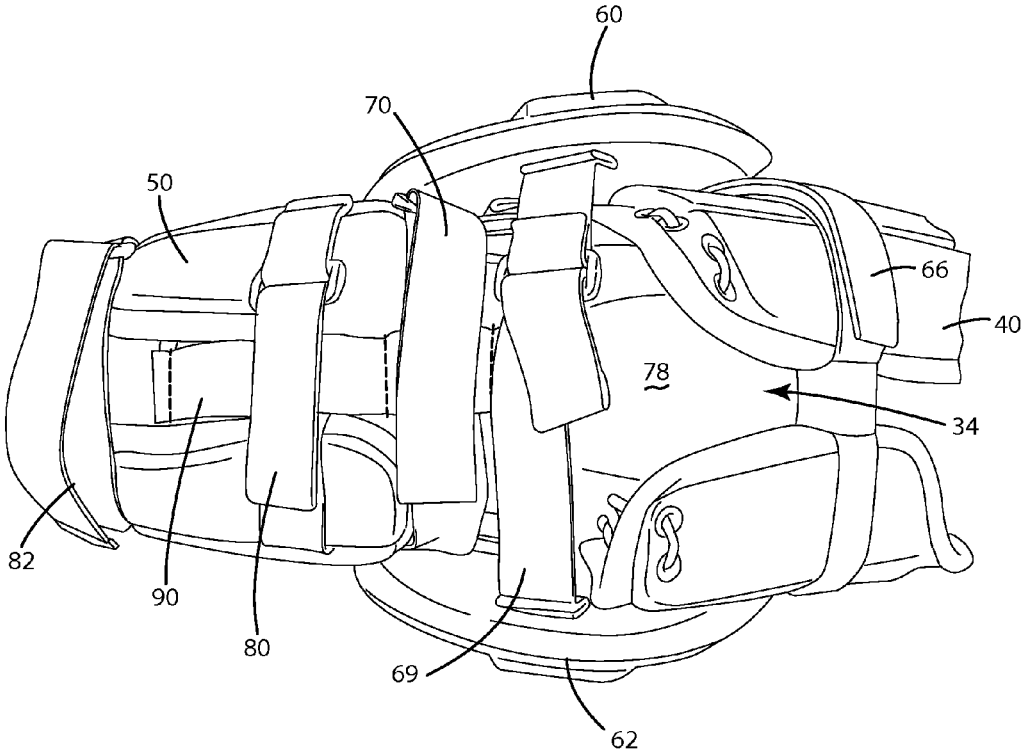
FIG. 10 is a second close-up view of an elbow cap of a current embodiment.

Referring now to FIGS. 9-10, each arm portion 14, 16 includes an elbow cap 34 opposite of the arm hinge 32. The elbow cap 34 generally includes a rigid outer shell and an inner layer of impact-absorbent padding for receiving the base of the wearer's elbow therein. The outer shell includes a spherically-shaped base 78 in the present embodiment, while in other embodiments the outer shell can be molded to include a non-spherically-shaped base, including for example a facetted base. In addition, the elbow cap 34 is coupled to the bicep-contacting padding 40 and the forearm-contacting padding 50. In particular, the elbow cap 34 is laced to the bicep-contacting padding 40 in the current embodiment, while other forms of attachment are also possible, including hook and loop connectors and snap connectors, for example.

More particularly, the elbow cap 34 includes transverse slots 84, 86 and a retaining webbing 90 for coupling the elbow cap 34 to the bicep-contacting padding 40 and the forearm-contacting padding 50. The transverse slots 84, 86 are sized to receive nylon lacing 88 therethrough, the nylon lacing 88 extending through eyelets in the bicep-contacting padding 40. The retaining webbing 90 extends longitudinally along the exterior of the elbow cap 34, having one or more loop openings for receipt of a corresponding strap therethrough. As shown in FIG. 9 for example, the retaining webbing 90 includes three openings for receipt of three respective straps. In other embodiments, greater or fewer number of openings may be used as desired.

As also shown in FIG. 10, three straps 69, 70, 80 extend across the rear of the elbow cap 34. Each strap is generally adjustable during donning and doffing of the chest protector 10. The uppermost strap 69 extends across the spherically-shaped base 78 of the elbow cap 34, including a first end portion coupled to the medial extension 60 and a second end portion coupled to the lateral extension 62. The intermediate strap 70 extends through a loop in the retaining webbing 90, the intermediate strap 70 being coupled at both ends to the floater pad lower portion 68 to urge the floater pad 58 against the forearm cap 48. The lowermost strap 80 extends through an additional loop in the retaining webbing 90, the lowermost strap 80 being coupled at both ends to the forearm contacting padding 50 to urge the forearm contacting padding comfortably against the wearer's forearm. An adjustable wrist strap 82 is generally separate fro the elbow cap 34 and retains the forearm contacting padding 50 in close proximity to the wearer's wrist.

The arm hinge 32 and the elbow cap 34 therefore cooperate to provide up to and including 360 degrees of protection to the wearer's elbow, while the forearm cap 48 and the bicep caps 36, 38 provide impact protection to predominantly the forward-facing portions of the wearer's lower and upper arm. In use, the elastic straps 68, 70 urge the floater pad 58 in the open position as shown in FIG. 1, while also permitting flexion of the elbow, and consequently the floater pad 58, to the flexed position as shown in FIG. 2. In addition, the channeled extensions 60, 62 guide movement of the floater pad 58 forward, rearward, and rotationally. For example, as the wearer reaches across the body, the arm hinge 32 can rotate inwardly to maintain protection for the inner elbow region. As the arm returns to the natural, extended position, the elastic straps 66, 70 urge the floater pad 58 into alignment with the gap between the bicep and forearm caps 38, 48. Advantageously, the pivot pins 72 and channels 70 also prevent the arm hinge 32 from riding up the bicep or down the forearm during play. In addition, the bicep caps 36, 38 and the bicep-contacting padding 40 cooperate to disperse an impact force across the upper arm portion 28, while the forearm cap 48 and forearm-contacting padding 50 cooperate to disperse an impact force across the lower arm portion 30, thereby lessening the risk of injury to the wearer.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. An arm protector comprising:

a protective upper arm portion;

a protective lower arm portion, the protective upper arm portion and protective lower arm portion joined with one another but defining a gap therebetween and generally located over an interior, forward facing bend of a wearer's elbow on the front of a wearer's arm, located between a bicep and a forearm of a wearer when the arm protector is worn by a wearer; and a protective arm hinge overlying the gap defined between the protective upper arm portion and the protective lower arm portion, the protective arm hinge including a forward-facing floater pad, a medial extension, and a lateral extension, the medial and lateral extensions guiding movement of the arm hinge relative to at least one of the upper arm portion and the lower arm portion, wherein the interior, forward facing bend of the wearer's elbow, opposite a tip of the wearer's elbow, is covered by at least the forward facing floater pad, wherein the medial and lateral extensions each define an elongated channel, each elongated channel including spaced apart end portions, each elongated channel including a respective guide pin longitudinally slidable therein during use of the arm protector in flexed and extended modes, the guide pin moving between the spaced apart end portions.

2. The arm protector of claim 1 wherein:

the protective upper arm portion includes a substantially rigid bicep cap; and the protective lower arm portion includes a substantially rigid forearm cap pivotally joined to the substantially rigid bicep cap.

3. The arm protector portion of claim 2 further including medial and lateral pivot pins extending into overlapping through holes in the bicep cap and forearm cap.

4. The arm protector of claim 3 wherein the medial and lateral pivot pins extend into medial and lateral elongated spots defined by the medial and lateral extensions, respectively, and the medial and lateral pivot pins are longitudinally slidable within the respective medial and lateral elongated slots so that the floater pad floats inward and outward relative to the interior forward facing bend of the wearer's elbow upon flexion and extension of the wearer's arm.

5. The arm protector of claim 2 further including a forearm-contacting padding layer extending across spaced-apart portions of the substantially rigid forearm cap to define an air gap between the padding layer and the forearm cap and to provide a trampoline effect when an impact is distributed to the forearm cap.

6. A chest protector comprising:

a torso protector portion; and first and second arm protector portions including an upper arm portion, a lower arm portion, and an arm hinge, wherein the arm hinge includes a forward-facing floater pad, disposed over an interior, forward facing bend of a wearer's elbow on the front of a wearer's arm, and an extension being slidably joined to at least one of the upper and lower arm portions to guide movement of the floater pad in the forward direction during rotation of the lower arm portion toward the upper arm portion, wherein the extension defines an elongated channel, wherein elongated channel includes spaced apart end portions, wherein a guide pin is longitudinally slidable relative to the elongated channel, travelling from a location adjacent one spaced apart end portion toward another spaced apart end portion during use.

7. The chest protector of claim 6 wherein the floater pad includes a first elastic strap extending across the lower arm portion and a second elastic strap extending across the upper arm portion, wherein the first and second elastic straps urge a floater pad upper portion against the upper arm portion and a floater pad lower portion against the lower arm portion.

8. The chest protector of claim 6 wherein the first and second arm protector portions include a substantially rigid elbow cap disposed over a tip of the wearer's elbow, opposite the floater pad.

9. The chest protector of claim 6 wherein the lower arm portion includes a substantially rigid forearm cap and a forearm-contacting padding layer extending across spaced-apart portions of the substantially rigid forearm cap to define an air gap between the padding layer and the forearm cap and to provide a trampoline effect when an impact is distributed to the forearm cap.

10. The chest protector of claim 6 wherein the upper arm portion includes a substantially rigid bicep cap and a bicep-contacting padding layer extending across spaced-apart portions of the substantially rigid bicep cap to define a gap between the padding layer and the bicep cap and to provide a trampoline effect when an impact is distributed to the bicep cap.

11. An arm protector comprising:

a protective upper arm portion configured to cover a wearer's bicep;

a protective lower arm portion configured to cover the wearer's forearm; and a protective arm hinge overlying a space defined between the protective upper arm portion and the protective lower arm portion, the arm hinge including a forward facing floater pad joined with a lateral extension pad, wherein the forward facing floater pad is located adjacent an interior bend of the wearer's elbow, the forward facing floater pad covering at least a portion of the space, wherein the lateral extension pad is positioned laterally of the protective upper arm portion and the protective lower arm portion, with the lateral extension pad covering at least a portion of the space, wherein the lateral extension pad defines an elongated slot, wherein at least one of the protective upper arm portion and the protective lower arm portion are joined with a guide pin that is longitudinally movable during use, relative to the elongated slot, the guide pin movable a distance between spaced apart end portions, the guide pin moving toward a first spaced apart end portion during extension of the wearer's arm, the guide pin moving toward a second spaced apart end portion during flexion of the wearer's arm, wherein the guide pin moves within the slot to guide movement of the arm hinge relative to at least one of the protective upper arm portion and the protective lower arm portion as a wearer flexes and extends an arm of the wearer on which the arm protector is worn, whereby the forward facing floater pad and the lateral extension pad remain covering respective portions of the space to cooperatively protect the wearer's inner elbow adjacent the space.

12. The arm protector of claim 11 further including a bridge extending across a portion of the forward facing floater pad and a portion of the lateral extension pad.

13. The arm protector of claim 12 wherein the slot is defined within the portion of the bridge extending across the portion of the lateral extension pad.

14. The arm protector of claim 12 wherein the floater pad portion includes first and second vertically spaced apart fold lines, the bridge extending laterally in the region between the first and second vertically spaced apart fold lines, the fold lines enabling the floater pod portion to fold forwardly, generally within the "v" shaped gap between a wearer's bicep and forearm during flexion of the wearer's arm.

15. The arm protector of claim 12 wherein the bridge is substantially rigid and is generally U-shaped.

16. The arm protector of claim 11 wherein the protective lower arm portion includes a substantially rigid forearm cap and a forearm-contacting padding layer extending across spaced-apart portions of the substantially rigid forearm cap to define an air gap between the padding layer and the forearm cap and to provide a trampoline effect when an impact is distributed to the forearm cap.

17. The arm protector of claim 11 wherein the protective upper arm portion includes a substantially rigid bicep cap and a bicep-contacting padding layer extending across spaced-apart portions of the substantially rigid bicep cap to define an air gap between the padding layer and the bicep cap and to provide a trampoline effect when an impact is distributed to the bicep cap.

18. The arm protector of claim 11 further including a substantially rigid elbow cap configured to be disposed over the tip of the elbow on the rear of the arm of the wearer, wherein the forward facing floater pad is configured to be disposed over the interior bend of the wearer's elbow on the front of the arm of a wearer, opposite the elbow cap.

19. The arm protector of claim 1 further including a substantially rigid elbow cap configured to be disposed over the tip of the elbow on the rear of the arm of the wearer, wherein the forward facing floater pad is configured to be disposed over the interior bend of the wearer's elbow on the front of the arm of a wearer, opposite the elbow cap.

* * * * *